United States Patent [19]

Albertin

[11] 3,941,512

[45] Mar. 2, 1976

[54] VENTILATING ARRANGEMENT FOR STEAM FLOW VACUUM PUMP

[75] Inventor: Michel Albertin, Annecy Le Vieux, France

[73] Assignee: Compagnie Industrielle des Telecommunications Cit-Alcatel, France

[22] Filed: Sept. 27, 1973

[21] Appl. No.: 401,543

[30] Foreign Application Priority Data

Sept. 27, 1972 France ..... 72.34187

[52] U.S. Cl. ..... 417/153; 165/122; 165/136; 165/185

[51] Int. Cl.[2] ..... F04F 9/00

[58] Field of Search ..... 417/153; 123/41.61, 41.65; 165/136, 125, 122

[56] References Cited

UNITED STATES PATENTS

| | | | |
|---|---|---|---|
| 1,580,371 | 4/1926 | Dyson et al. | 165/184 |
| 1,961,905 | 6/1934 | Michell | 123/41.61 |
| 1,974,033 | 9/1934 | Nallinger | 123/41.65 |
| 3,086,283 | 4/1963 | Webber et al. | 165/80 X |
| 3,346,042 | 10/1967 | Seehauser | 165/136 |
| 3,360,188 | 12/1967 | Stuffer | 417/153 |
| 3,442,094 | 5/1969 | Rush et al. | 165/136 X |

FOREIGN PATENTS OR APPLICATIONS

| | | | |
|---|---|---|---|
| 899,520 | 6/1962 | United Kingdom | 417/153 |

*Primary Examiner*—C. J. Husar
*Assistant Examiner*—Richard E. Gluck
*Attorney, Agent, or Firm*—Craig & Antonelli

[57] ABSTRACT

A steam flow vacuum pump has a grooved cylindrical pump body surrounded by a housing having a radius slightly greater than the pump body and a high-power ventilator pulsating the air in the housing. The housing is provided with vents on the opposite side to the ventilator. The swirling flow of the air causes a great cooling of the pump body.

3 Claims, 5 Drawing Figures

FIG. 2
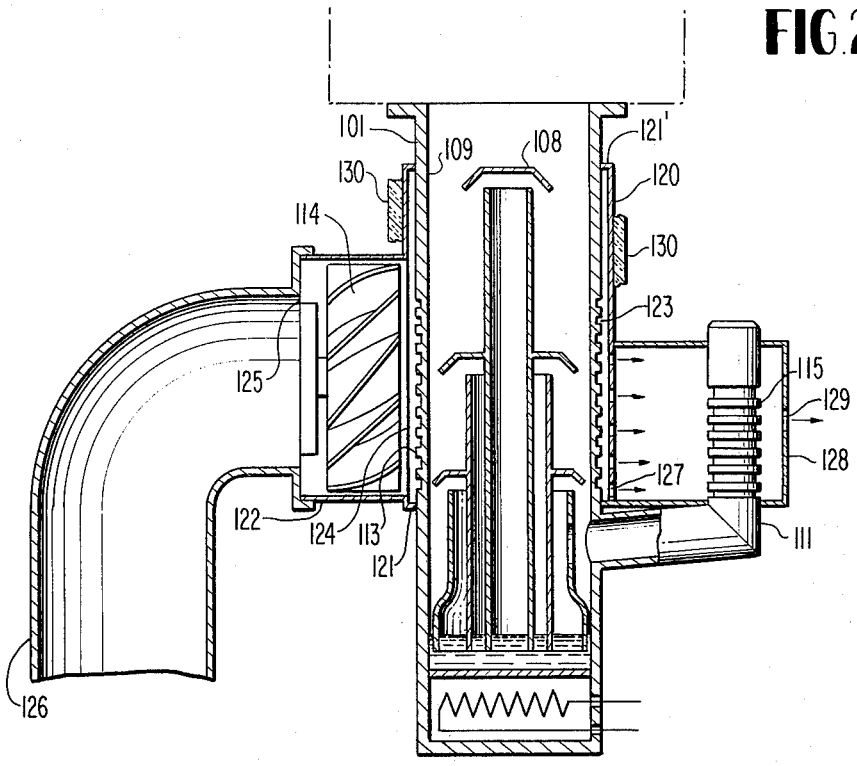
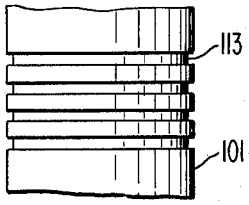
FIG. 4a
FIG. 3
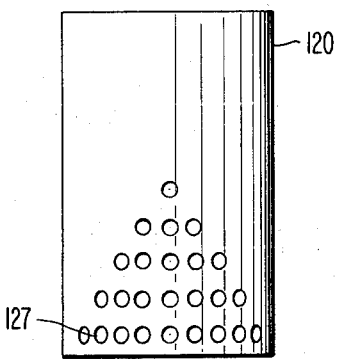
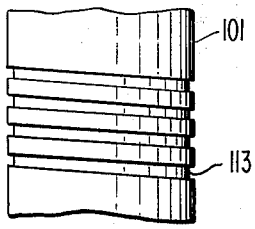
FIG. 4b

VENTILATING ARRANGEMENT FOR STEAM FLOW VACUUM PUMP

The invention relates to a steam flow vacuum pump comprising a cylindrical pump body cooled by an air current produced by a ventilator. Steam flow pumps are generally used as secondary pumps and enable high vacuums to be obtained.

It is known that in these pumps, the driving of gaseous molecules to be removed is provided by diffusion of these molecules in a steam current which flows from a hot source or boiler, where a suitable liquid is brought to boiling point, to a cold zone constituted by the inside wall of the pump body, where the steam formed is condensed.

To keep the cold condensing zone at a suitable temperature, a cooling fluid is made to flow on the outside of the pump body. Although water is good cooling fluid, for convenience's sake, attempts have been made to manufacture air-cooled pumps. Air-cooled pumps comprise large cooling fins welded on the outside wall of the pump body as well as a lateral ventilator blowing, on these fins, a horizontal air flow. These air-cooled pumps have the disadvantage of being much more bulky than water-cooled pumps and allow only a relatively low power to be removed; that is, why only low-power pumps have been produced for this application.

Moreover, these pumps cannot operate in a hot atmosphere, for the temperature of the cold wall follows the temperature of the ambient air, this disturbing the operation of the pump as soon as the ambient temperature reaches 40°C., thus rendering them often unsuitable for use on pumping frames where the atmosphere is confined.

The pump according to the invention enabling these disadvantages to be overcome comprises a cylindrical pump body whose axis is vertical, cooled by an air flow obtained by a ventilator, characterized in that the pump body is provided, on its outside surface, with grooves and is surrounded, on the greater part of its height, by a cylindrical housing having the same axis and a slightly larger radius fixed at its upper part and at its lower part by two annular segments to the pump body, the said housing comprising an opening through which arrives the air pulsated by the ventilator and by the vents, placed on the opposite side to the ventilator, through which the air is driven out.

In the pump body according to the invention, the air flow is no longer laminar, as in known pumps, but has a swirling configuration.

Indeed, in the pump according to the invention, the air flows at high speed in a cylindrical space having slight thickness comprised between the housing and the grooved wall of the pump body; the presence of grooves causes the swirling of the flow, this causing a high degree of cooling.

The pump according to the invention has the advantage of being less bulky than known air-cooled pumps and may be used in a confined atmosphere where the temperature is relatively high.

According to an improvement of the invention, a pipe enabling the air to be sucked in from a certain distance, at points where it is the coolest, is fitted to the ventilator blowing into the space comprised between the housing and the pump body.

The following description with reference to the accompanying drawings will make it easier to understand how the invention may be embodied.

FIG. 2 shows diagrammatically the pump according to the invention;

FIG. 3 shows a preferred arrangement of the vents in the housing;

Figure 1:
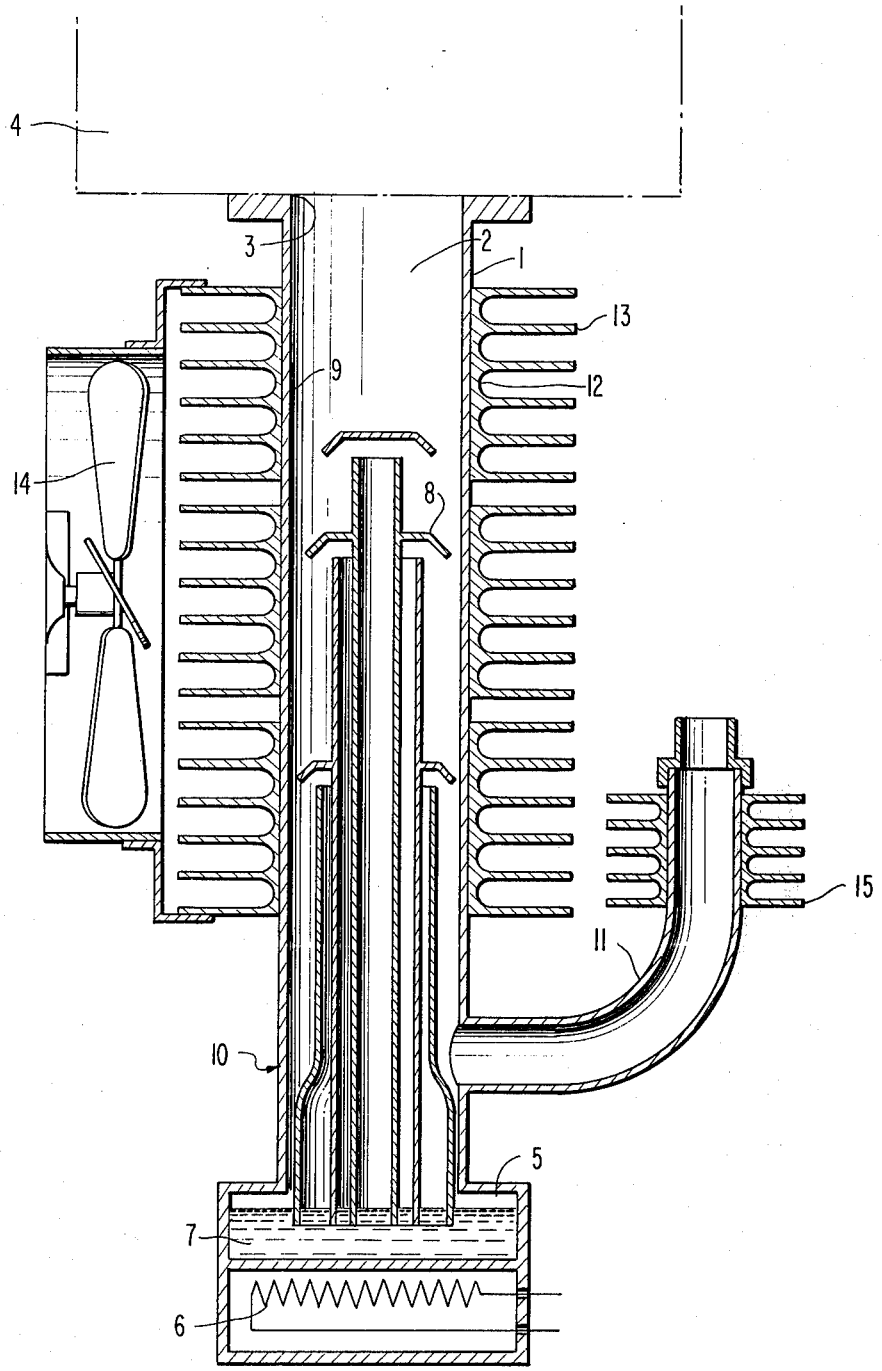
FIG. 1 PRIOR ART
FIG. 1 shows air-cooled pump of known type.

FIGS. 4*a* and 4*b* show different embodiments of the grooved surface of the pump according to the invention.

FIGS. 1 and 2 are on the same scale and show pumps having the same discharge rate (250 l/second A.V.S., American Vacuum Society standards).

The air-cooled steam flow vacuum pump of known type such as shown in FIG. 1 comprises a cylindrical pump body 1 in which is formed a cylindrical chamber 2 having a vertical axis communicating at its top 3 with a vacuum enclosure 4, whereas its bottom 5, which constitutes the boiler and is heated by an electrical resistor 6, contains a liquid 7 having low vapor pressure, such as mercury or oil. The chamber 2 also contains ejectors 8 designed for collecting the steam which forms above the liquid 7 to direct it in jets towards the upper part 9 of the lateral wall 10 of the chamber, that upper part 9 constituting the cold condensing zone. A cross-head 11 connected to the lateral wall 10 between the zone 9 and the boiler 5 is connected up to a primary pump (not shown) which has the function of removing the gas molecules driven by the stream current going from the boiler 5 to the zone 9.

The lateral wall 10 of the pump body is made of a metal having average conductivity such as stainless steel.

An aluminium sleeve 12 fitted with large cooling fins 13 is welded, in the casting stage, to the outside of the pump body so as to surround the zone 9 to be cooled. A lateral ventilator 14 blows onto the fins 13 an air flow which runs in a laminar way along these fins 13.

The cross-head 11 is also fitted with fins 15 enabling, by cooling of the fins 15, the scavenging of the drive fluid to be achieved thoroughly.

The pump according to the invention such as illustrated in FIG. 2 comprises a cylindrical pump body 101 whose wall is fitted, on the outside, with grooves 113 and a cross-head 111 also fitted with grooves 115.

The cold condensation zone 109 placed on the level of the ejectors 108 is surrounded on the outside by a cylindrical housing 120 fixed to its lower part and to its upper part by two annular segments 121. The housing 120 has the same axis as the cylindrical body and a slightly larger radius.

A high-power helical ventilator 114 placed in a casing 122 fixed to the housing 120 and communicating with the inside space 123 comprised between the housing 120 and the pump body 101 by an opening 124.

The casing 122 also comprises a suction hole 125 to which is fitted a pipe 126 enabling air to be drawn off from a zone where it is the coolest.

The housing 120 is provided with vents 127 through which air is driven out and goes to cool the end of the cross-head 111. These vents are arranged on the opposite side to the ventilator 114. The housing 120 is constituted by or coated with a thermally insulating material 130, as shown in partial illustration in FIG. 2, protecting the space 123 from the influence of ambient radiations and the ambient air.

The air sucked in from a zone where it is the coolest is projected by the high-power ventilator 114 into the space 123. The air flows at high speed in the space 123 by reason of the small dimensions of the latter and, in contact with the flow grooves, starts to swirl, this causing a high degree of cooling of the pump body and proper operation of the pump even in an atmosphere at a relatively high temperature.

A secondary housing 128 bearing against the housing 120 and used for directing the air leaving the vents 127 at the grooved end of the cross-head 111 may be added. An air bleed hole 129 is provided in the secondary housing on the opposite side to the vents 127.

FIG. 3 shows the preferred arrangement of the vents 127 in the housing 120.

The number of vents 127 decreases from the bottom of the housing 120 towards the top, so that the air flow current is at its maximum near the bottom of the housing and decreases progressively, from the top to the bottom of the housing 120. The best cooling is therefore obtained at the level of the lower ejector, this improving the pump output.

FIGS. 4*a* and 4*b*, respectively, show different arrangements of the grooved surface of the cylindrical pump body 101. For example, in FIG. 4a the grooves 113 are circular with respect to the cylindrical pump body 101, while in FIG. 4b the grooves are helical with respect to the cylindrical pump body 101.

Although the pump which has just been described may appear to afford the greatest advantages for putting the invention into effect, it will be understood that various modifications may be made thereto without going beyond the scope of the invention, it being possible to replace certain of its elements by other elements capable of fulfilling the same techincal function or an equivalent technical function therein.

What is claimed is:

1. in a steam flow vacuum pump cooling means for cooling the pump by an air flow comprising a cylindrical pump body provided with grooves on at least a portion of the outer surface thereof, a cylindrical housing coaxially mounted on said pump body to enclose at least the portion thereof containing said grooves, said cylindrical housing having a radius which is only slightly larger than the radius of said pump body, and ventilator means connected to an intake opening in said cylindrical housing for supplying an air flow to said housing, said housing also including a plurality of vent holes to permit escape of said air flow, characterized in that the vent holes are disposed in successive circumferential rows in said housing and the number of vent holes in each row decreases from the bottom of the pump towards the top thereof.

2. A steam flow vacuum pump according to claim 1, wherein said vent holes are disposed in said housing at a position diametrically opposite said intake opening.

3. In a steam flow vacuum pump cooling means for cooling the pump by an air flow comprising a cylindrical pump body provided with grooves on at least a portion of the outer surface thereof, a cylindrical housing coaxially mounted on said pump body to enclose at least the portion thereof containing said grooves, said cylindrical housing having a radius which is only slightly larger than the radius of said pump body, and ventilator means connected to an intake opening in said cylindrical housing for supplying an air flow to said housing, said housing also including a plurality of vent holes to permit escape of said air flow, characterized in that said pump includes a cross-head communicating with the interior of said pump body and having, towards its end disposed outside the pump body, a plurality of grooves around which the air leaving said vent holes flows, and characterized in that the air leaving said vent holes is directed towards the grooves of the cross-head by means of a secondary housing surrounding the grooved end of the cross-head and fixed to the housing surrounding the pump body and provided with an air discharge hole on the opposite side to the vent holes.

* * * * *